US008085205B2

(12) United States Patent
Chen et al.

(10) Patent No.: US 8,085,205 B2
(45) Date of Patent: Dec. 27, 2011

(54) ANTENNA MODULE AND AN ELECTRONIC DEVICE HAVING THE ANTENNA MODULE

(75) Inventors: Yin-Yu Chen, Taipei Hsien (TW); Chen-Yu Chou, Taipei Hsien (TW); Chih-Cheng Lin, Taipei Hsien (TW); Yu-Lun Teng, Taipei Hsien (TW)

(73) Assignee: Wistron Corporation, Taipei Hsien (TW)

( * ) Notice: Subject to any disclaimer, the term of this patent is extended or adjusted under 35 U.S.C. 154(b) by 317 days.

(21) Appl. No.: 12/453,013

(22) Filed: Apr. 28, 2009

(65) Prior Publication Data

US 2010/0026592 A1 Feb. 4, 2010

(30) Foreign Application Priority Data

Jul. 29, 2008 (TW) ..... 97128652 A

(51) Int. Cl.
*H01Q 1/24* (2006.01)

(52) U.S. Cl. ..... 343/702; 343/700 MS

(58) Field of Classification Search ..... 343/702, 343/700 MS
See application file for complete search history.

(56) References Cited

U.S. PATENT DOCUMENTS 6,211,830 B1 * 4/2001 Monma et al. ..... 343/702
2006/0097928 A1 * 5/2006 Takaba et al. ..... 343/702

* cited by examiner

*Primary Examiner* — Dieu H Duong
(74) *Attorney, Agent, or Firm* — Bacon & Thomas, PLLC

(57) ABSTRACT

An antenna module for wireless signal transmission of an electronic device is disclosed. The antenna module comprises an antenna body and a fixing part. The antenna body comprises a radiating element, a grounding element, a connecting element, and a feeding point. The radiating element has a first radiating area and a second radiating area. The connecting element has a first end and a second end. The first end is connected with the first radiating area of the radiating element and the second end is connected with the grounding element. The feeding point is disposed on the radiating element and is used to feed a signal. The fixing part comprises a main body and a first clip portion. The main body is used to match the shape of the antenna body. The first clip portion is used to clip and fix the antenna body.

10 Claims, 6 Drawing Sheets

ANTENNA MODULE AND AN ELECTRONIC DEVICE HAVING THE ANTENNA MODULE

BACKGROUND OF THE INVENTION

1. Field of the Invention

The present invention relates to an antenna module and, more particularly, to an antenna module having a reduction volume and fixed by a fixing part.

2. Description of the Related Art

With developments in technologies, many electronic devices in the market, such as portable navigation devices (PND) or personal navigation devices with wireless communications capabilities, have become lighter and smaller. In particular, users require that not only the functionalities of the portable devices; but they also require the portable devices to be lightweight and slim. Therefore, a traditional antenna cannot be disposed in portable devices.

In order to solve the aforementioned problem, a chip antenna design is disclosed in the prior art. Please refer to FIG. 1A. FIG. 1A is a schematic drawing of a chip antenna disclosed in the prior art. The chip antenna 90 of the prior art has a main body 91 and an antenna body 92. The antenna body 92 is disposed on the main body 91. The main body 91 is made of ceramic material. The antenna body 92 is used to transmit a wireless signal. The antenna body 92 has a radiating element 921, a connecting element 922 and a grounding element 923. The connecting element 922 has a first end 922*a* and a second end 922*b*; the first end 922*a* of the connecting element 922 is connected to the radiating element 921; and the second end 922*b* is connected to the grounding element 923. The chip antenna 90 can reduce the volume of the device with the combination of the main body 91 and the antenna body 92.

However, when the chip antenna 90 in the prior art is used for transmitting the wireless signal, the transmission efficiency is only about 30% to 45%. In addition, the chip antenna 90 might be affected by other elements easily. Therefore, when the chip antenna 90 is disposed in electronic devices, there can be no other metal elements disposed around the antenna body 92 if interference of the transmission effect of the chip antenna 90 is to be avoided.

Therefore, it is desirable to provide an antenna to mitigate and/or obviate the aforementioned problems.

SUMMARY OF THE INVENTION

A main objective of the present invention is to provide an antenna module having a reduction volume and fixed by a fixing part.

Another objective of the present invention is to provide an electronic device having the antenna module.

In order to achieve the above mentioned objective, the electronic device of the invention comprises an antenna module and a wireless transmission module. The antenna module electrically connects to the wireless transmission module. The antenna module comprises an antenna body and a fixing part. The antenna body comprises a radiating element, a grounding element, a connecting element, and a feeding point. The radiating element has a first radiation area and a second radiation area. The connecting element has a first end and a second end; the first end is perpendicularly connected to the first radiation area of the radiating element substantially and the second end is perpendicularly connected to the grounding element substantially. The feeding point is disposed on the radiating element and used for feeding a signal. The fixing part comprises a main body and a first clip portion.

The main body is used to match the shape of the antenna body. The first clip portion is used to clip and fix the antenna body.

Other objects, advantages, and novel features of the invention will become more apparent from the following detailed description when taken in conjunction with the accompanying drawings.

DETAILED DESCRIPTION OF THE PREFERRED EMBODIMENT

The advantages and innovative features of the invention will become more apparent from the following descriptions of the preferred embodiments.

Figure 1:
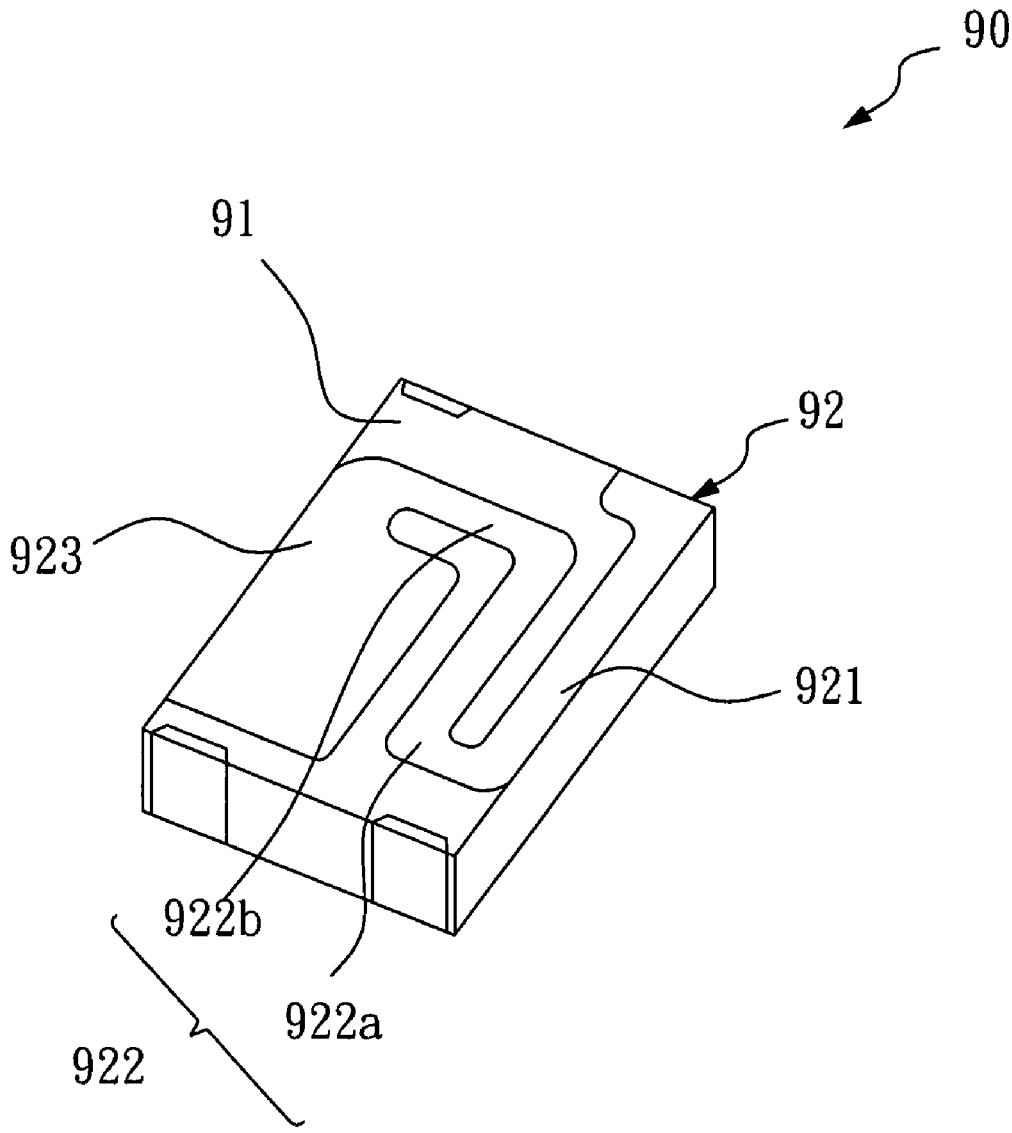
FIG. 1 (Prior Art)
FIG. 1 is a schematic drawing of a chip antenna in the prior art.
Figure 2:
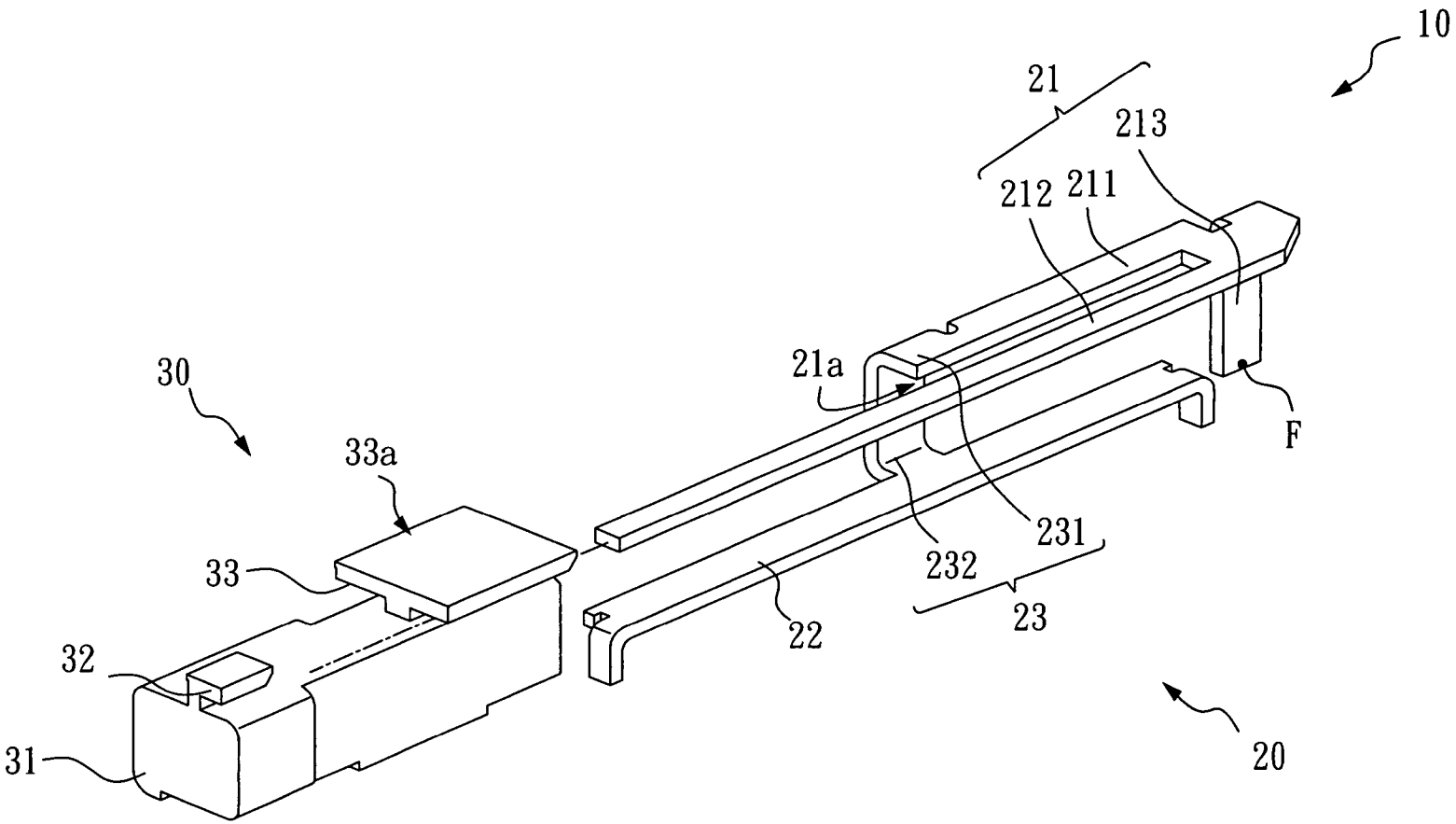
FIG. 2 is a perspective drawing of a separation of an antenna module and a fixing part according to an embodiment of the invention.
Figure 3:
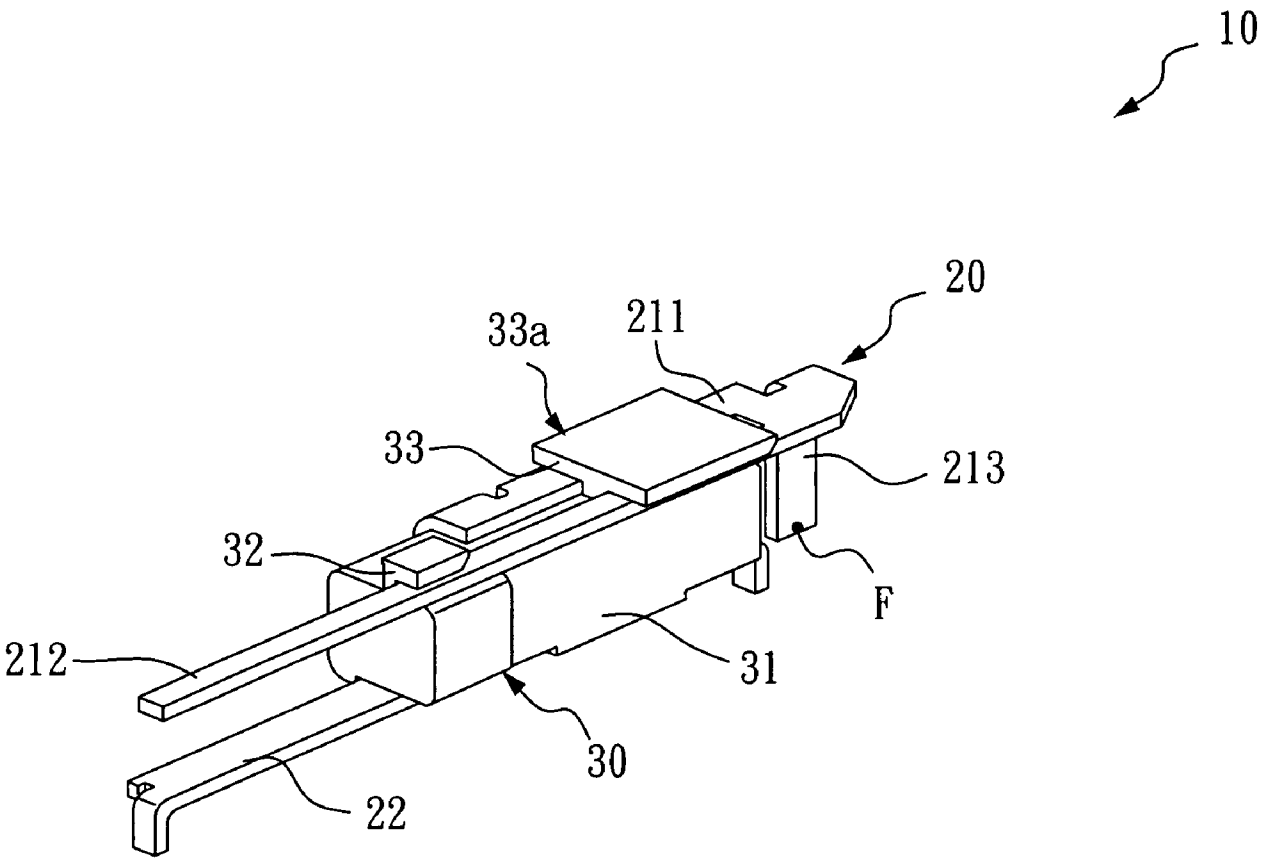
FIG. 3 is a perspective drawing of a combination of the antenna module and the fixing part according to an embodiment of the invention.

Please refer to FIG. 2 and FIG. 3. FIG. 2 is a perspective drawing of the separated parts of an antenna module and a fixing part according to an embodiment of the invention, and FIG. 3 is a perspective drawing of the composed whole of the antenna module and the fixing part according to an embodiment of the invention.

In this embodiment, an antenna module 10 is a wireless fidelity (Wi-Fi) antenna. The Wi-Fi antenna is used to transmit in the frequency band ranging from 2.4 GHz to 2.5 GHz. The antenna module 10 comprises an antenna body 20 and a fixing part 30. The antenna body 20 is a patched inverse F antenna (PIFA), and the shape of the antenna body 20 matches with the fixing part 30. The antenna body 20 comprises a radiating element 21, a grounding element 22, a connecting element 23, and a feeding point F. The radiating element 21 is composed of a metal. When current is fed into the radiating element 21, the radiating element 21 excites radiation energy. The radiating element 21 comprises a first radiation area 211, a second radiation area 212, and a third radiation area 213, which are connected to each other. A gap 21*a* is disposed between the first radiation area 211 and the second radiation area 212; therefore, the antenna body 20 can be fixed on the fixing part 30 by the gap 21*a*. The fixation will be described in detail later.

The grounding element 22 is also composed of a metal and used for grounding the antenna body 20. The connecting element 23 comprises a first end 231 and a second end 232. The first end 231 of the connecting element 23 is perpendicularly connected to the first radiation area 211 of the radiating element 21 substantially, and the second end 232 of the connecting element 23 is perpendicularly connected to the grounding element 22 substantially. The third radiation area 213 of the radiating element 21 further comprises a feeding point F. The feeding point F and a feeding line (not shown) are electrically connected to each other and used for transmitting an electrical signal. The feeding line can be an RF cable or other type of transmission line.

With the connection relationship of the all elements aforementioned, the antenna body 20 becomes a 3-D structure. The antenna body 20 can decrease the height from the radiating element 21 to the grounding element 22 to reduce the volume of the antenna body 20. Therefore, the antenna body 20 can be disposed in an electronic device with a small structural space.

The fixing part 30 is composed of a plastic which is able to endure high temperatures. The fixing part 30 comprises a main body 31, a first clip portion 32, and a second clip portion 33. The shape of the main body 31 is matching with the antenna body 20. As shown in FIG. 2 and FIG. 3, the height of the main body 31 is equal to the distance from the radiating element 21 to the grounding element 22; therefore, the antenna body 20 is able to be disposed on the fixing part 30. The first clip portion 32 is used to clip the second radiation area 212 of the radiating element 21. The second clip portion 33 passes through the gap 21*a* disposed between the first radiation area 211 and the second radiation area 212 to clip the first radiation area 211 and the second radiation area 212. The antenna body 20 is able to be fixed on the fixing part 30 with the first clip portion 32 and the second clip portion 33.

Figure 6:
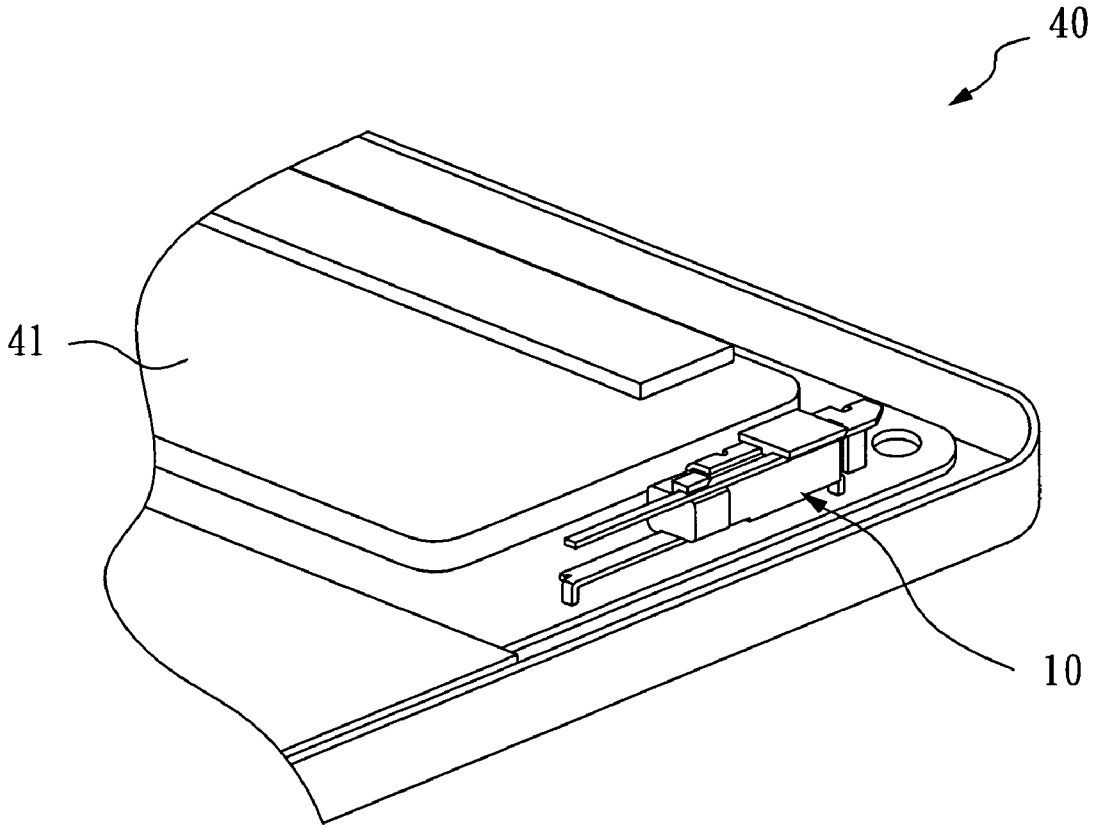
FIG. 6 is a schematic drawing of the antenna module according to an embodiment of the invention disposed in an electronic device.

The second clip portion 33 further has a platform structure 33*a*. The surface area of the platform structure 33*a* matches the size of the vacuum sucker (not shown). Therefore, the antenna module 10 executes a fabricated flow to be disposed in the electronic device 40 (as shown in FIG. 6) by the platform structure 33*a* conveniently. The fabrication method can be performed by a surface-mount device (SMD), but the invention is not limited to the above.

Figure 4:
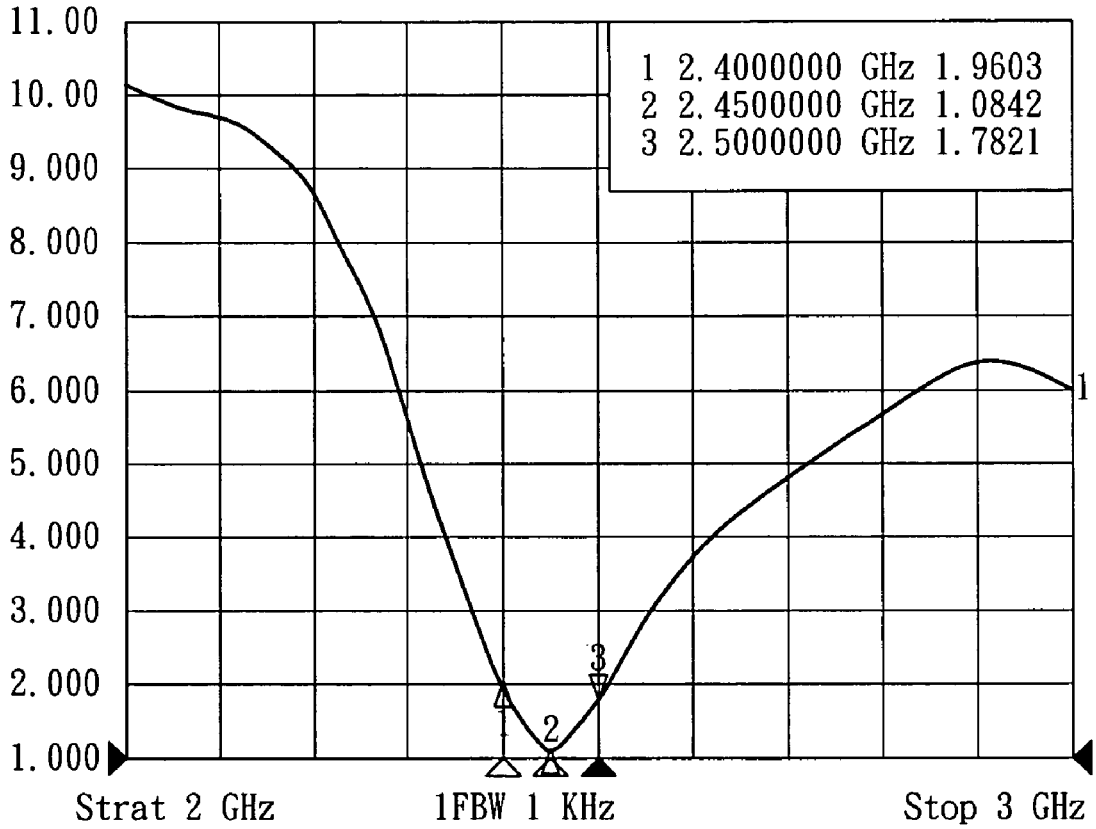
FIG. 4 shows the VSWR at different frequencies of the antenna module according to an embodiment of the invention.

Please refer to FIG. 4. FIG. 4 shows the VSWR at different frequencies of the antenna module according to an embodiment of the invention.

As shown in FIG. 4, the antenna module 10 is capable of transmitting signals with frequencies from 2.4 GHz to 2.5 GHz with the aforementioned structure. Therefore, the antenna module 10 of the invention satisfies the requirements of the Wi-Fi antenna.

Figure 5A:
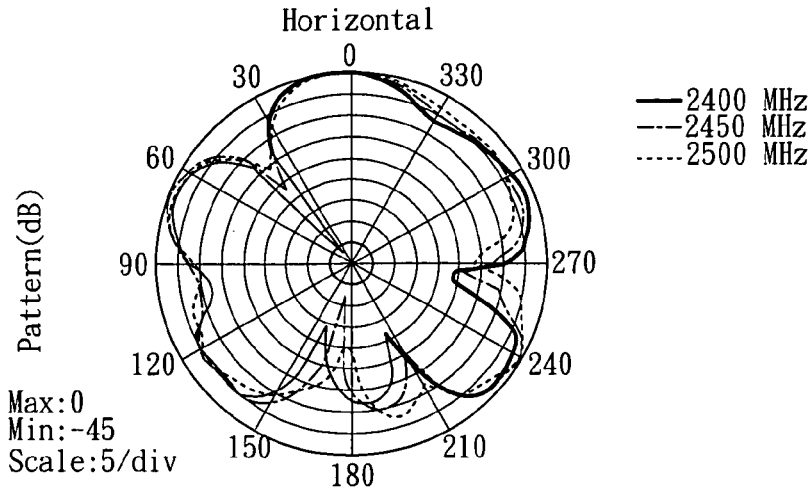
FIG. 5A shows different radiation patterns in the horizontal plane of the antenna module according to an embodiment of the invention.
Figure 5B:
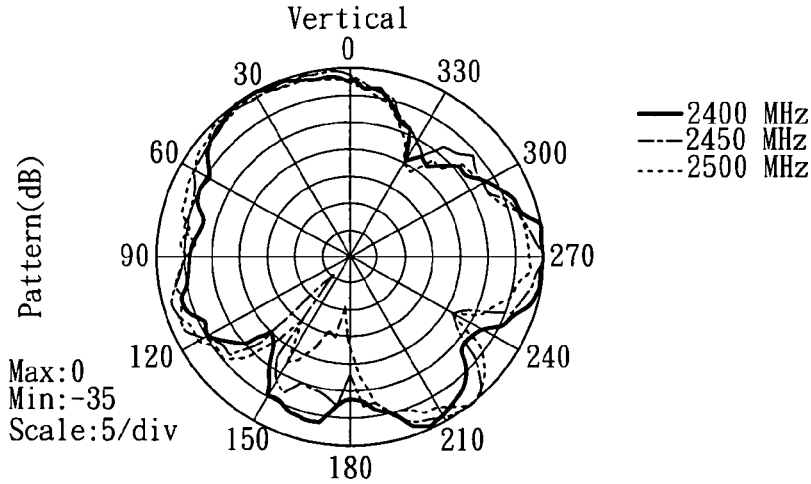
FIG. 5B shows different radiation patterns on the vertical plane of the antenna module according to an embodiment of the invention.
Figure 5C:
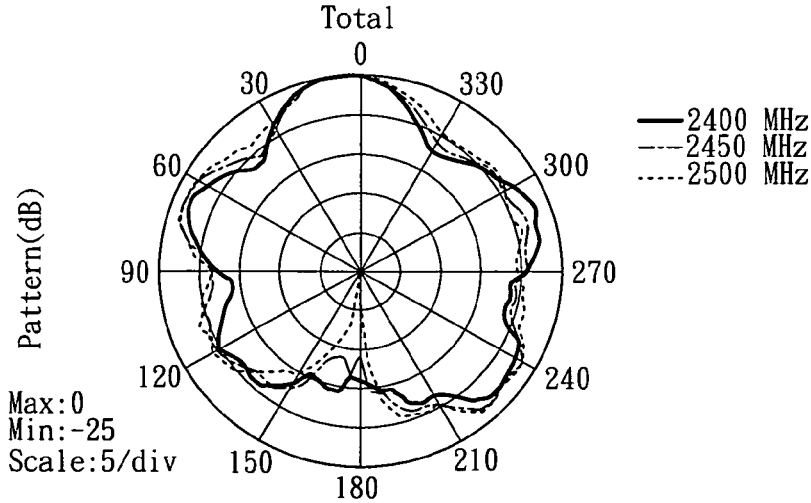
FIG. 5C shows the different radiation patterns of the antenna module according to an embodiment of the invention.

Please refer to FIG. 5A, FIG. 5B, and FIG. 5C. FIG. 5A shows different radiation patterns on the horizontal plane of the antenna module according to an embodiment of the invention. FIG. 5B shows different radiation patterns on the vertical plane of the antenna module according to an embodiment of the invention. FIG. 5C shows the different radiation patterns of the antenna module according to an embodiment of the invention.

As shown in FIG. 5A to FIG. 5C, the antenna module 10 can centralize the magnetic field radiation to a specific direction, and the antenna module 10 is thus able to function as a directional antenna. The transmission efficiency of the antenna module 10 can be 39% to 59%, which is obviously superior to the transmission efficiency of the chip antenna 90 of the prior art.

Please refer to FIG. 6. FIG. 6 is a schematic drawing of the antenna module according to an embodiment of the invention disposed in an electronic device. In one embodiment of the invention, an electronic device 40 can be a portable navigation device, a personal navigation device or any other portable device having a small structural space. As shown in FIG. 6, the electronic device 40 comprises an antenna module 10 and a wireless transmission module 41. The antenna module 10 is disposed on a side of the electronic device 40. The invention uses RF cables (not shown) to provide a feed to the antenna module 10 and is connected to a wireless transmission module 41 to use the wireless transmission module 41 to process signals from the antenna module 10, such as transmission signals or reception signals. In contrast to the chip antenna 90 in the prior art, objects comprising metal can be disposed around the antenna module 10 without causing interference with the wireless signals. The electronic device 40 can thus use the antenna module 10 to transmit or receive wireless signals from or to other devices (not shown).

Although the present invention has been explained in relation to its preferred embodiment, it is to be understood that many other possible modifications and variations can be made without departing from the spirit and scope of the invention as hereinafter claimed.

What is claimed is:

1. An antenna module comprising:

an antenna body comprising:

a radiating element having a first radiation area and a second radiation area a grounding element;

a connecting element having a first end and a second end, the first end substantially perpendicularly connected to the first radiation area of the radiating element, and the second end substantially perpendicularly connected to the grounding element; and a feeding point disposed on the radiation element to feed a signal; and a fixing part comprising:

a main body used for disposing the antenna body; and a first clip portion used for clipping and fixing the antenna body, wherein a gap is disposed between the first radiation area and the second radiation area; the fixing part further comprises a second clip portion; the second clip portion passes through the gap to clip the first radiation area and second radiation area.

2. The antenna module as claimed in claim 1, wherein the radiation element further comprises a third radiation area, wherein the feeding point is disposed on the third radiation area.

3. The antenna module as claimed in claim 1, wherein the second clip portion has a platform structure.

4. The antenna module as claimed in claim 1, wherein the antenna body is a three dimension structure.

5. The antenna module as claimed in claim 1, wherein the fixing part is composed of a plastic.

6. An electronic device having an antenna module and capable of wireless transmissions comprising:

a wireless transmission module; and the antenna module electrically connected to the wireless transmission module, the antenna module comprising:

an antenna body comprising:

a radiating element having a first radiation area and a second radiation area;

a grounding element;

a connecting element having a first end and a second end, the first end substantially perpendicularly connected to the first radiation area of the radiating element, and the second end substantially perpendicularly connected to the grounding element; and a feeding point disposed on the radiation element to feed a signal; and a fixing part comprising:

a main body used for disposing the antenna body; and a first clip portion used for clipping and fixing the antenna body, wherein a gap is disposed between the first radiation area and the second radiation area; the fixing part further comprises a second clip portion; the second clip portion passes through the gap to clip the first radiation area and second radiation area.

7. The electronic device having the antenna module as claimed in claim 6, wherein the radiation element further comprises a third radiation area, wherein the feeding point is disposed on the third radiation area.

8. The electronic device having the antenna module as claimed in claim 6, wherein the second clip portion has a platform structure.

9. The electronic device having the antenna module as claimed in claim 6, wherein the antenna body is a three dimension structure.

10. The electronic device having the antenna module as claimed in claim 6, wherein the fixing part is composed of a plastic.

* * * * *